United States Patent [19]

Zunkel

[11] Patent Number: 4,635,716

[45] Date of Patent: Jan. 13, 1987

[54] GRAVEL PACKER

[75] Inventor: Gary D. Zunkel, Chickasha, Okla.

[73] Assignee: Halliburton Company, Duncan, Okla.

[21] Appl. No.: 756,886

[22] Filed: Jul. 19, 1985

[51] Int. Cl.[4] ..... E21B 43/04

[52] U.S. Cl. ..... 166/51; 166/126; 166/131; 166/150

[58] Field of Search ..... 166/51, 126, 128, 129, 166/131, 144, 150, 152, 278, 377, 386

[56] References Cited

U.S. PATENT DOCUMENTS

| | | | |
|---|---|---|---|
| 3,126,963 | 3/1964 | Graham | 166/51 |
| 3,153,451 | 2/1964 | Chancellor et al. | 166/51 |
| 3,421,586 | 1/1969 | Solum | 166/51 |
| 3,627,046 | 12/1971 | Miller et al. | 166/278 |
| 3,637,010 | 1/1972 | Maly et al. | 166/51 |
| 3,710,862 | 1/1973 | Young et al. | 166/278 |
| 3,726,343 | 4/1973 | Davis, Jr. | 166/278 |
| 3,901,318 | 8/1975 | Fortenberry | 166/278 |
| 3,913,676 | 10/1975 | Barbee, Jr. et al. | 166/278 |
| 3,926,409 | 12/1975 | Abney et al. | 251/344 |
| 3,952,804 | 4/1976 | Smyrl | 166/278 |
| 3,963,076 | 6/1976 | Winslow | 166/278 |
| 3,987,854 | 10/1976 | Callihan et al. | 166/278 |
| 4,044,832 | 8/1977 | Richard et al. | 166/278 |
| 4,049,055 | 9/1977 | Brown | 166/278 |
| 4,105,069 | 8/1978 | Baker | 166/51 |
| 4,192,375 | 3/1980 | Maly et al. | 166/51 |
| 4,273,190 | 6/1981 | Baker et al. | 166/278 |
| 4,295,524 | 10/1981 | Baker et al. | 166/278 |
| 4,296,807 | 10/1981 | Hendrickson et al. | 166/184 |
| 4,418,754 | 12/1983 | Stepp | 166/278 |
| 4,438,815 | 3/1984 | Elson et al. | 166/278 |
| 4,440,218 | 4/1984 | Farley | 166/51 |
| 4,474,239 | 10/1984 | Colomb et al. | 166/278 |

*Primary Examiner*—James A. Leppink
*Assistant Examiner*—Hoang C. Dang
*Attorney, Agent, or Firm*—Joseph A. Walkowski

[57] ABSTRACT

The present invention comprises a weight-set single-zone gravel packer which may be retrieved from a gravel screen after gravel packing or, alternatively, left in place attached to the screen as a production packer. The gravel packer includes a compression-set packer element, a first J-slot assembly to releasably maintain the gravel packer in an unset mode, a ratchet assembly to releasably lock the gravel packer in a set mode, an intake passage to receive fluid from a tubing string, a return passage to receive fluid from the interior of a gravel screen below the gravel packer, a closeable crossover assembly to receive fluid from the return passage to the wellbore annulus above the gravel packer, a first check valve to prevent flow down to the gravel screen through the return passage, a second check valve adapted to selectively connect the intake passage with the gravel packer, and a second J-slot assembly for selectively disconnecting the tubing string from the gravel packer.

19 Claims, 8 Drawing Figures

GRAVEL PACKER

BACKGROUND OF THE INVENTION

This invention relates to a tool for use in gravel packing wells. More specifically, the invention relates to a retrievable gravel packing tool for effecting a circulate-squeeze type gravel pack.

In wells in geological formations where the production of sand from the formation along with the liquids and gases being produced therefrom is a problem, it is well known in the art to install a screen in the production tubing and pack gravel around the screen to prevent the sand from the formation flowing into the production tubing. In such an arrangement, a gravel pack screen assembly is run into the formation on a string of tubing to the desired location and gravel, typically a slurry of coarse sand mixed in a gelled liquid, is pumped down to the exterior of the gravel pack screen assembly to fill the area between the screen assembly and the formation. After a sufficient amount of gravel has been pumped down to the exterior of the gravel pack screen assembly to completely fill the area between the screen assembly and the formation, the screen assembly is released from the tubing string and the tubing removed from the well with production tubing subsequently being installed in the well.

It is common to circulate the gravel-laden liquid outside the screen assembly, and to return the liquid through the screen to the surface, leaving the gravel in place around the screen assembly. After the initial circulation, the operator may want to further consolidate the gravel pack, which is done through squeezing, or applying pressure to the gravel pack after closing the circulation path used to return the gravel-laden liquid to the surface. It is also desirable to reverse-circulate gravel-laden fluid out of the tubing string and gravel pack screen assembly prior to retrieving it from the wellbore.

SUMMARY OF THE INVENTION

The present invention relates to a weight-set single-zone gravel packer which may be retrieved from a gravel screen after gravel packing or, alternatively, left in place attached to the screen as a production packer. The gravel packer includes a compression-set packer element, first J-slot means to releasably maintain the gravel packer in an unset mode, ratchet means to releasably lock the gravel packer in a set mode, an intake passage to receive fluid from a tubing string, a return passage to receive fluid from the interior of a gravel screen below the gravel packer, closeable crossover means to receive fluid from the return passage to the wellbore annulus above the gravel packer, first check valve means to prevent flow down to the gravel screen through the return passage, second check valve means adapted to selectively connect the intake passage with the return passage, and second J-slot means for selectively disconnecting the crossover means and the tubing string from the gravel packer.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF THE PREFERRED EMBODIMENT

Figure 1A:
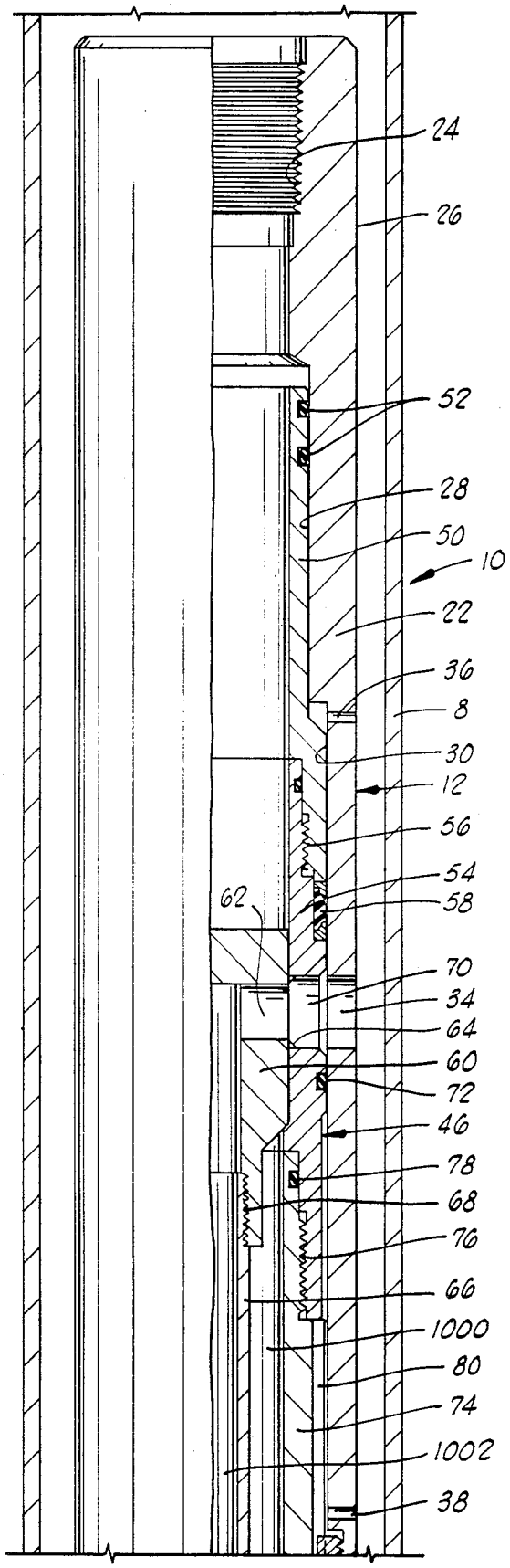
FIGS. 1A–1F comprise a detailed half-section elevation of the gravel packer of the present invention disposed in a cased wellbore in an unset mode.
Figure 1B:
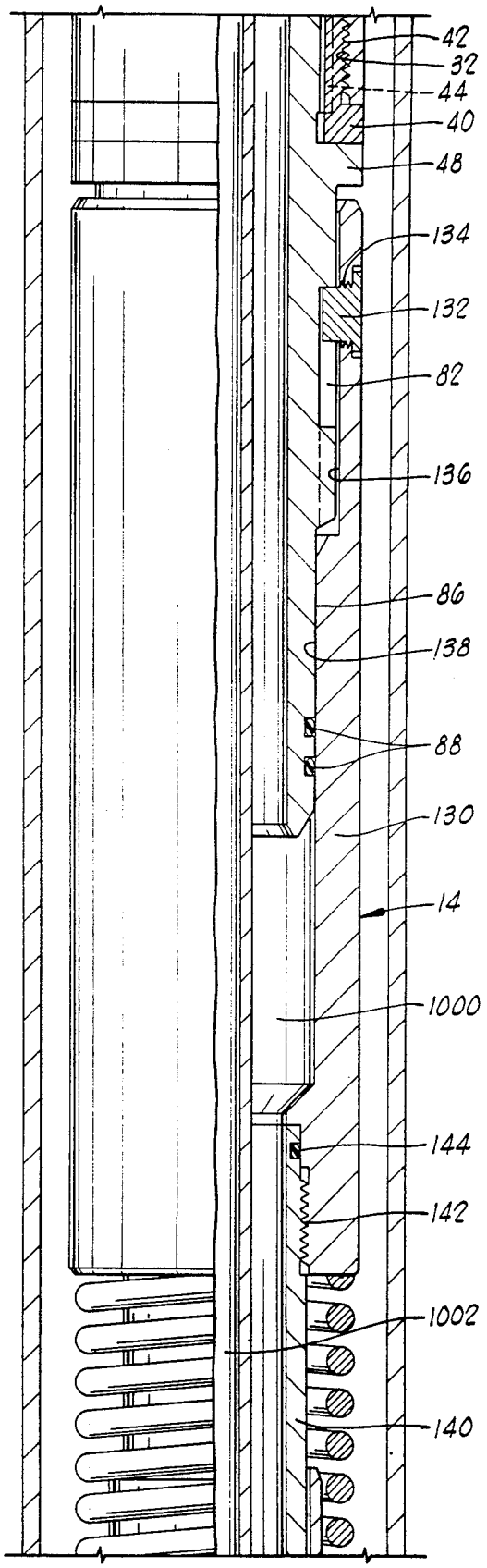
Figure 1C:
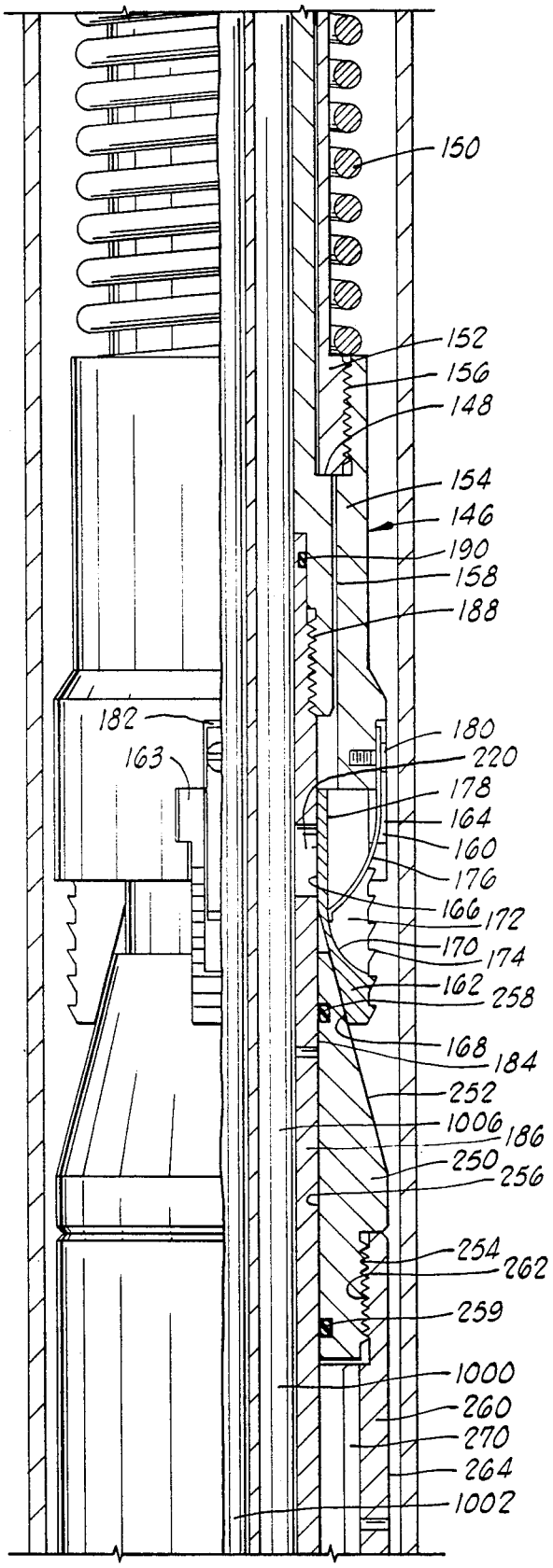
Figure 1D:
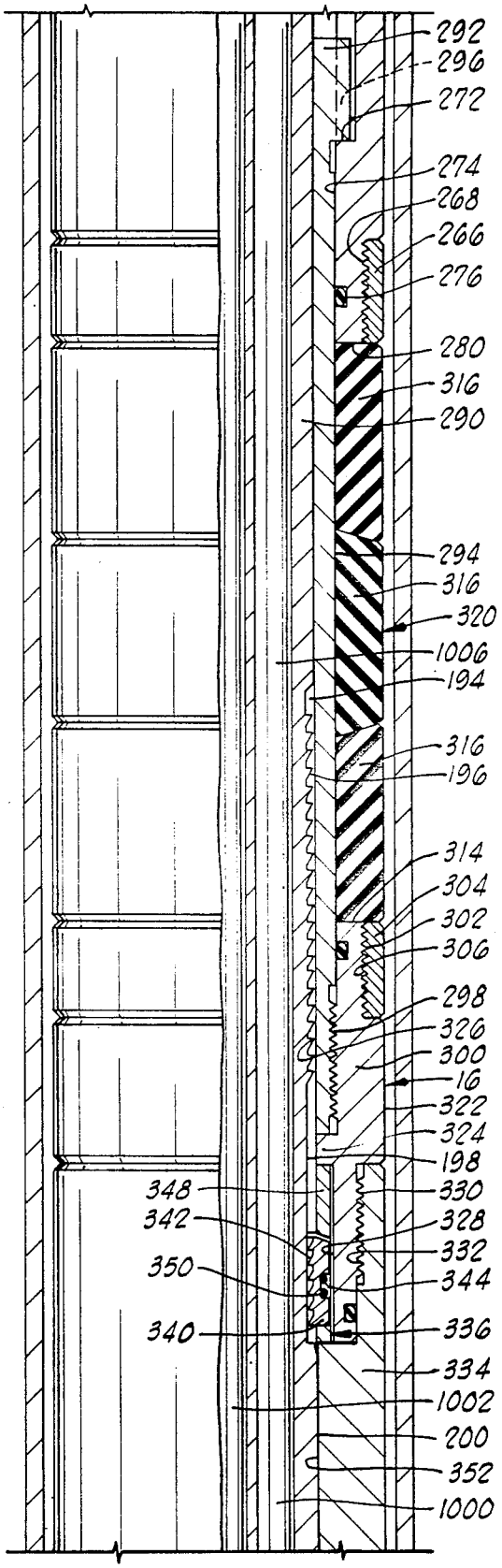
Figure 1E:
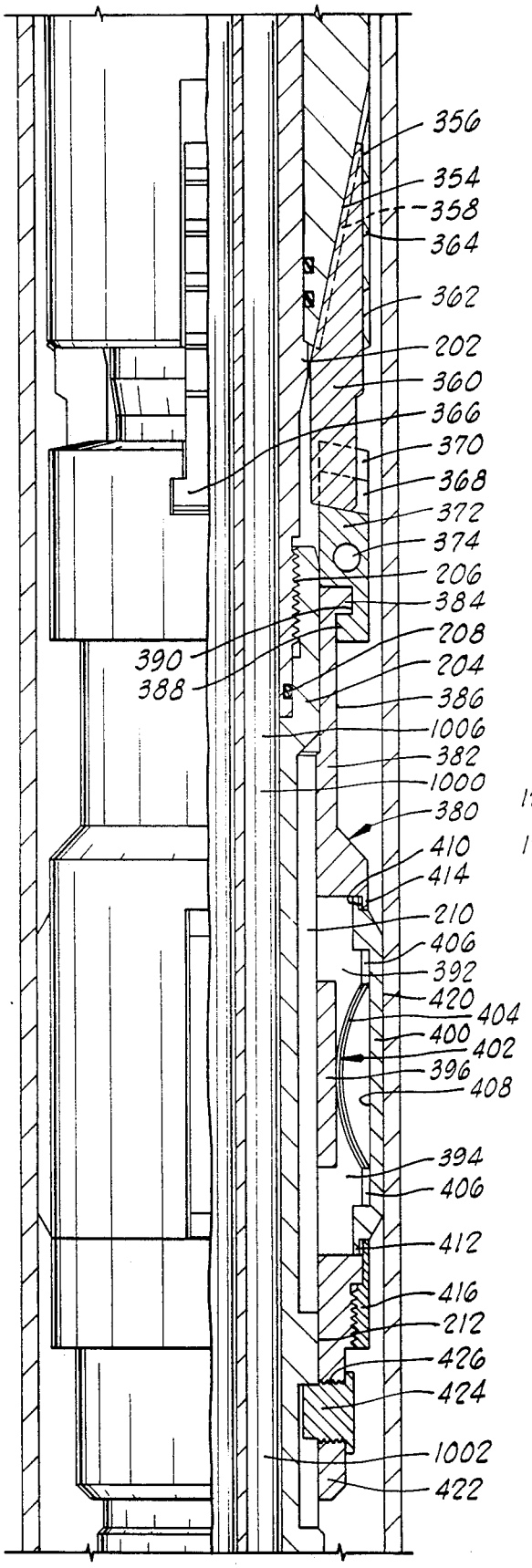
Figure 1F:
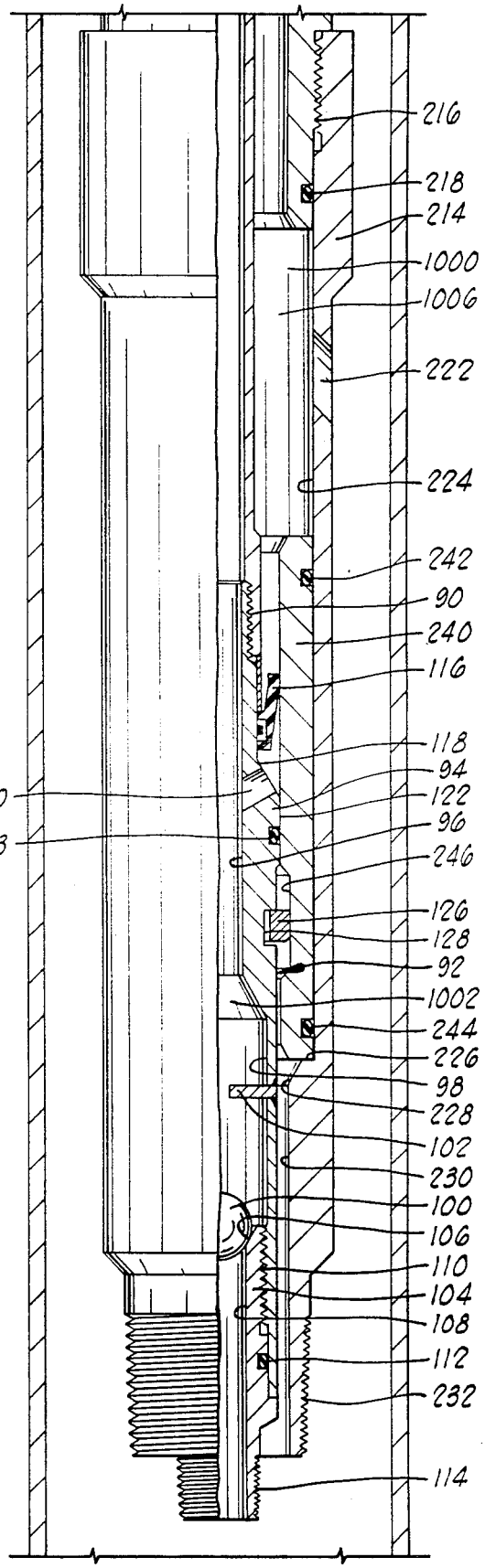
Figure 2:
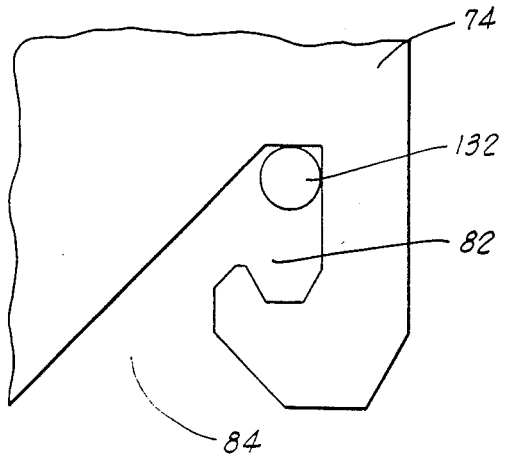
FIGS. 2 and 3 comprise developments of the J-slots employed in the gravel packer of the present invention.
Figure 3:
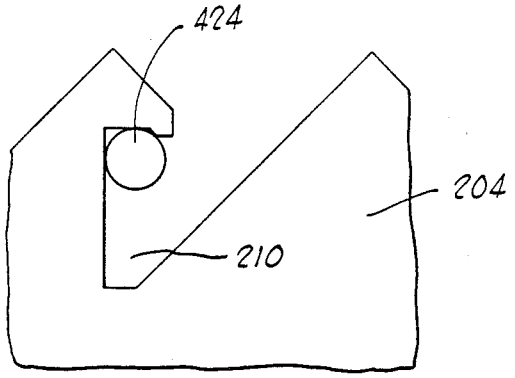

Referring to FIGS. 1A–1F, 2 and 3, gravel packer 10 disposed in wellbore casing or liner 8 comprises crossover assembly 12, mandrel assembly 14 and housing assembly 16.

Crossover assembly 12 includes tubular crossover housing 22 having threaded adapter bore 24 at its upper end to secure gravel packer 10 to a tubing string thereabove (not shown). Crossover housing 22 has a cylindrical exterior 26, and an interior below adapter bore 24 including first cylindrical seal bore 28, second cylindrical seal bore 30, and threaded exit bore 32. A plurality of crossover ports 34 extend through the wall of housing 22 to open on second seal bore 30, vent passages 36 and 38 extending through the wall of housing 22 above and below crossover ports 34. Keyway collar 40 is secured by threaded surface 42 to threaded exit bore 32, keyway collar 40 including longitudinal keyways 44 cut in the interior thereof.

Tubular crossover sleeve assembly 46 is slidably disposed in housing 22, upward travel thereof limited by the abutment of keyway collar 40 against annular shoulder 48.

Crossover sleeve assembly 46 includes seal sleeve 50 carrying O-rings 52 thereon, which is secured to crossover body 54 by threads 56, crossover seal 58 interposed therebetween. Crossover tee 60 having T-shaped passage 62 therethrough is welded to crossover body 54 at 64, and return mandrel 66 is secured thereto at threaded junction 68. Crossover apertures 70 in crossover body 54 are aligned with the horizontally disposed outlets of crossover passage 62, while return mandrel 66 communicates with the bottom outlet thereof. O-ring seal 72 is disposed about crossover body 54 below apertures 70. J-slot housing 74, from which annular shoulder 48 protrudes, is secured at threaded junction 76 to crossover body 54, O-ring 78 effecting a seal therebetween. Longitudinal keys 80 extend radially from J-slot housing 74 into keyways 44 to prohibit mutual rotation between crossover housing 22 and crossover sleeve assembly 46.

Below annular shoulder 48, first J-slots 82 are cut into the exterior of J-slot housing 74, first J-slots 82 having open bottoms 84 (see FIG. 2) which communicate with lower seal surface 86, carrying O-rings 88 thereon.

At the lower end of crossover assembly 12, return mandrel 66 is secured at threaded junction 90 to check valve assembly 92, which includes tubular check valve mandrel 94. The interior of mandrel 94 includes upper return bore 96, below which ball check bore 98 of greater diameter houses check ball 100 below roll pin 102. Check valve seat 104, of tubular configuration with ball seat 106 at the top of bore wall 108, is secured to check valve mandrel at threaded junction 110, O-ring 112 sealing therebetween. Check ball 100 and check valve seat 104 comprise a first check valve means. The lower end of check valve seat 104 includes threaded trailing surface 114, to which a tailpipe or washpipe (not shown) extending into a gravel screen below gravel packer 10, may be secured.

Packer cup 116 is disposed about check valve mandrel 94 above frusto-conical surface 118, through which oblique reversing passages 120 extend from upper return base 96. Below reversing passages 120, cylindrical surface 122 carries O-ring 123, below which recessed cylindrical snap-ring surface 124 carries snap-ring 126 in annular groove 128.

Crossover housing 22, keyway collar 44, seal sleeve 50, crossover body 54, crossover tee 60, J-slot housing 74, return mandrel 66, check valve mandrel 94, ball 100, roll pin 102, seal 104, packer cup 116 and snap-ring 126 comprise the major elements of crossover assembly 12.

Mandrel assembly 14 includes overshot 130, which rides over the lower end of J-slot housing 74, J-slot lugs 132, secured to overshot 130 at threads 134, protruding radially inward into J-slots 82 from undercut 136. Below undercut 136, seal bore 138 rides against O-rings 88 on J-slot housing 74.

Tubular slip mandrel 140 is secured to overshot 130 at threaded junction 142, O-ring 144 sealing therebetween. Upper slip assembly 146 rides on slip mandrel 140, biased against annular shoulder 148 by coil spring 150, acting between slip assembly 146 and overshot 130.

Slip assembly 146 includes sleeve 152, which rides on slip mandrel 140 above shoulder 148, and is secured to slip collar 154 at threaded junction 156, slip collar 154 extending downward over lower exterior surface 158 of slip mandrel 140. Longitudinally extending, circumferentially disposed slots 160 extending to the bottom of slip collar 154 accommodate slips 162 therein, laterally extending legs 163 at the upper ends of slips 162 residing in lateral channels 164 of slots 160. Slips 162 have arcuate inner surface 166, leading to oblique bottom surfaces 168, while the exterior of each slip 162 includes a longitudinal slot 170 bounded by slip walls 172 having teeth 174 thereon. Leaf springs 176 contacting the bottoms 178 of slots 170, and anchored by bolts 180 in spring slots 182 of slip collar 154, maintain slips 162 against exterior seal surface 184 of upper bypass mandrel 186, which is joined to slip mandrel 140 at threaded junction 188, O-ring 190 sealing therebetween.

Upper bypass mandrel 186 includes cylindrical seal surface 184, at the lower end of which recessed surface 194 possesses left-hand ratchet threads 196 cut thereon. Below ratchet threads 196, smooth dog saddle 198 extends to lower seal surface 200, terminating at annular shoulder 202. Below shoulder 202, upper bypass mandrel 186 is secured to J-slot mandrel 204 at threaded junction 206, O-ring 208 sealing therebetween. Tubular J-slot mandrel 204 has J-slot 210 (see FIG. 3) cut into the exterior surface 212 thereof, below which lower bypass mandrel 214 is secured to J-slot mandrel 204 at threaded junction 216, O-ring 218 sealing therebetween. Bypass ports 220 extend through the wall of upper bypass mandrel 286, and circulating ports 222 extend through the wall of lower bypass mandrel 214.

Lower bypass mandrel 214 includes sleeve bore 224, terminating at inwardly extending annular shoulder 226, leading to chamfered surface 228 and exit bore 230. The trailing end of lower bypass mandrel 214 includes threaded surface 232 thereon, to which a gravel screen (not shown) below gravel packer 10 may be secured.

Tubular valve sleeve 240 is slidably disposed in sleeve bore 224 between the lower end of J-slot mandrel 204 and annular shoulder 226. O-rings 242 and 244 effect a seal between lower bypass mandrel 214 and valve sleeve 240, while O-ring 123 carried on check valve mandrel 94 seals between sleeve 240 and mandrel 94. Elongated snap-ring recess 246 on the interior of sleeve 240 accommodates snap-ring 126, while packer cup 116 forms a second check valve means with the interior of sleeve 240.

Mandrel assembly 14 is comprised of the following major elements: overshot 130, spring 150, slip mandrel 140, upper slip assembly 146, upper bypass mandrel 186, J-slot mandrel 204, lower bypass mandrel 214, and valve sleeve 240.

Housing assembly 16 includes upper slip wedge collar 250, having frusto-conical slip ramp 252 at the top thereof, threaded cylindrical surface 254 therebelow on the exterior, and an axial bore defined by bore wall 256 extending therethrough, through which upper bypass mandrel 186 is slidably disposed, O-rings 258 and 259 in bore wall 256 of slip wedge collar 250 sealing against upper bypass mandrel 186.

Spline case 260 is secured to collar 250 by threaded entry bore 262 mating with threaded surface 254. Exterior cylindrical surface 264 extends downward to packer compression ring 266, which surrounds the lower end of spline case 260 and is joined thereto at threaded junction 268. The interior of spline case 260 includes longitudinally extending splines 270, which extend substantially to radial shoulder 272, below which the interior necks down to seal bore 274, having an O-ring 276 disposed therein. The lower ends of case 260 and co-extensive packer compression ring 266 provide radially flat upper packer compression shoulder 280.

Tubular packer saddle 290 extends through seal bore 274 of case 260, the upper annular end 292 of saddle 290 being of larger diameter than cylindrical packer element surface 294 and containing longitudinal slots 296 therein which slidably mate with splines 270 on the interior of case 260.

Saddle 290 is secured at threaded junction 298 to adapter 300, adapter 300 having threads 302 on its upper exterior by which lower packer compression ring 304 is secured via thread 306. An O-ring 308 carried in seal bore 320 of adapter 300 seals against packer element surface 294 of saddle 290. Lower packer compression ring 304 and the upper face 320 of adapter 300 provide a radially flat lower packer compression shoulder 314. Three annular elastomeric packer elements 316 comprise packer element means 320 and are disposed about packer saddle 290.

The exterior 322 of adapter 300 is substantially cylindrical while the annular shoulder 324 on the interior thereof below threaded junction 298 is cylindrical and of substantially the same diameter as bore 326 of saddle 290, recessed ratchet bore 328 extending to the lower end of adapter 300 therebelow. On the lower exterior of adapter 300, threaded surface 330 engages threaded bore 332 on the interior of lower slip wedge collar 334. Ratchet dog annulus 336, defined between adapter 300, lower slip wedge collar 334 and upper bypass mandrel 186, contains a plurality of arcuate ratchet dogs 340 having left-hand threads 342 cut on the interior thereof, and circumferentially extending slots 344 on the exterior thereof. Spacer ring 348 disposed in ratchet dog annulus 336 separates ratchet dogs 330, ring 348 having apertures in which ratchet dogs 340 are disposed and also containing a circumferential slot therein aligned with slots 344 on dogs 330. Garter springs or elastic bands 350 extend through the aligned slots and about ratchet dogs 340 and ring 348.

The bore 352 of collar 334 is substantially the same as that of bore 326 of packer saddle 290. The lower exterior of collar 334 comprises slip ramps 354 separated by spacer walls 356 having undercut therein lateral channels 358 adjacent the surface of ramps 354. Lower slips 360 ride on ramps 354, lateral webs (not shown) extending into channels 358 in walls 356. The upper exterior of slips 360 comprises slip face 362 having teeth 364 thereon. The lower exterior of slips 360 comprises T-shaped strut 366, the laterally oriented ends of which extend into grooves 368 in the sides of strut channels 370 at the upper end of lower slip collar 372, which is comprised of a plurality of arcuate sections secured together by bolts 374 to form a collar.

Drag block assembly 380 includes drag block housing 382 which interlocks via outwardly facing annular shoulder 384 and recess 386 with inwardly facing shoulder 388 and recess 390 on lower slip collar 372 as the arcuate segments forming slip collar 372 are secured together. Drag block housing 380 contains a plurality of drag block cavities 392 therein, separated by walls 294, arcuate spring bases 396 extending therebetween about J-slot mandrel 204. Drag blocks 400 are disposed in cavities 392 over leaf springs 402, the centers 404 of which bear against spring bases 396, and the ends 406 of which bear against drag blocks 400 in spring cavities 408. Lips 410 and 412 at each end of drag blocks 400 extend longitudinally therefrom, retainer edge 414 maintaining top lips 410 inside cavities 392, and retainer collar 416, which is secured at threaded junction 418 to drag block housing 382, maintains lower lips 412 in cavities 392. The exteriors 420 of drag blocks 400 bear against the walls of casing 8, and may have carbide inserts (not shown) embedded therein to reduce wear.

The lower end of drag block housing 382 comprises lug collar 422, having J-slot lugs 424 secured therein by threaded junction 426, and protruding into lower J-slot 210.

Several passages are defined within gravel packer 10, these being intake passage 1000, return passage 1002, and bypass passage 1006. Intake passage 1000 extends from the top of crossover assembly 12, around crossover tee 60 and becomes annular in shape as it extends downward between return mandrel 66 and the interior of mandrel assembly 14, terminating at circulation ports 222. Return passage 1002 extends from check valve assembly 92 upward to crossover assembly 12 through the bore of return mandrel 66, into crossover tee 60 to apertures 70 and ports 34 in crossover assembly 12. Bypass passage 1006 extends from bypass ports 220 through the annulus between return mandrel 66 and mandrel assembly 14, to circulation ports 222.

OPERATION OF THE PREFERRED EMBODIMENT

Referring to FIGS. 1A–1F, 2 and 3, gravel packer 10 may be suspended from a tubing string (not shown) in wellbore casing or liner 8, with a gravel screen such as is well known in the art suspended therebelow from threaded surface 232 via a slip joint; if desired, the distance between gravel packer 10 and the screen may be increased with blank pipe. A washpipe or tailpipe is normally suspended from threaded surface 114 at the end of check valve seat 104 and extends into the screen, which extends across a producing formation to be gravel packed. As the tubing string is run into the wellbore, fluid can move around packer element means 310 via bypass passage 1006, and the tubing string is filled through circulation ports 222 and intake passage 1000.

After running the tubing string into the wellbore, the bottom of the wellbore is tagged with the gravel screen and the slip joint is compressed. The string is then picked up to extend the slip joint while leaving the screen on bottom.

Gravel packer 10 is then set by application of right-hand rotation through crossover assembly 12 and mandrel assembly 14, which moves J-slot lugs 424 to positions (see FIG. 3) below the open tops of J-slots 210. Actually, it is J-slots 210 on mandrel assembly 14 which are moved with respect to the lugs 424 on housing assembly 16. The tubing string is then set down, which sets lower slips 360 against lower slip wedge collar 334 through movement of mandrel assembly 14 with respect to housing assembly 16, the latter's movement being restricted by drag blocks 400. After lower slips 360 set against casing 8, continued downward travel of mandrel assembly 14 closes bypass passage 1006 by bringing bypass ports 220 between O-rings 258 and 259 at which time upper slip assembly 146, biased by spring 150, contacts upper slip wedge collar 250 and forces it and spline case 260 downward, compressing packer element means 320 against casing 8 after which upper slips 162 contact and set against casing 8. The downward travel of mandrel means assembly 14 results in ratchet dogs 340 engaging ratchet teeth 196, locking gravel packer 10 in a set mode, spring 180 aiding in maintaining it therein. The packer is then pulled upward by the tubing string to test the ratchet engagement and upper slips, closing crossover assembly 12, and the annulus between the tubing string and casing 8 is pressured up to test the seal of packer element means 320 against casing 8.

Gravel packer 10 may then be released from the gravel screen, if desired, via an hydraulic releasing tool in a manner disclosed in co-pending U.S. patent application Ser. No. 756,892, filed 7/19/85 assigned to Halliburton Company and incorporated herein by reference.

Alternatively, the gravel screen with attached mandrel assembly 14 and housing assembly 16 may be released from the crossover assembly 12 and the tubing string after the screen is gravel packed.

To gravel pack, the tubing string is set down to open crossover assembly 12 by placing crossover apertures 70 in communication with crossover ports 34. Circulation is then established through passage 1000, through circulation ports 222, into the annulus below gravel packer 10, down to the gravel screen and through the apertures therein, up the washpipe into return passage 1002, out of crossover assembly 12 through apertures 70 and ports 34, and up the annulus above gravel packer 10 to the surface.

The desired fluid injection rate is then established by pulling up on the tubing string to close crossover assembly 12, and pressuring up the tubing until it is ascertained that fluid can be pumped into the formation at a desired rate and pressure. If not, the formation may have to be treated with acid to increase its permeability. If the injection rate is satisfactory, bypass ports 220 can then be opened to "spot" the gravel-laden slurry to gravel packer 10 by pulling against the tubing string, applying pressure to the annulus, rotating the tubing string to the right 12 to 16 turns to release ratchet dogs 340 from ratchet threads 196 and uncover bypass ports 220, indicated at the surface by a relieving of the pressure in the annulus. Slurry can then be spotted down to the gravel packer 10 without circulating fluid through the gravel screen, as fluid below packer element means 320 will be displaced upward into the annulus via bypass ports 220 by the slurry traveling down the tubing string and into intake passage 1000. After slurry spotting, the tubing string is set down to close bypass ports 220 and open crossover assembly 12. The slurry is circulated out ports 222 and down to the screen, the gravel being deposited outside the screen adjacent the formation, fluid returns being taken up the washpipe past unseated check ball 100, into return passage 1002, through cross-over assembly 12 to the annulus above gravel packer 10.

After the gravel pack is placed, the tubing string is again pulled against the set gravel packer 10 to close crossover assembly 12, and the pack slurry is squeezed into the formation and against the screen through intake passage 1000, circulation ports 220 and the lower annulus below gravel packer 10. If desired, the operator may alternate between circulating and squeezing several times to place more gravel and ensure the integrity of the pack. It should be noted that gravel packer 10 permits squeezing without subjecting the casing above packer element means 310 to squeeze pressure, an important feature in wells with old or otherwise deteriorated casing.

Excess slurry can be reverse circulated out of the tubing string gravel packer 10 and the annulus thereabove, by circulating clean fluid down the annulus to crossover assembly 12, down return passage 1002 where check ball 100 is seated on ball seat 106, out reversing passage 120 past packer cup 116, and up intake passage 1000 to the surface through the tubing string.

The gravel pack can be retested if desired in the circulate and/or squeeze mode, and repacking done if necessary, in the same manner described above.

If a releasing tool has been employed therebelow the gravel packer 10 may then be unset, by pulling the tubing string against gravel packer 10, applying pressure to the annulus, rotating the tubing string to the right to release the ratchets and open bypass ports 220 (indicated by relief of annulus pressure). The tubing string is then pulled up to retract upper slips 162, unset packing element means 320, unset lower slips 360 and return lugs 424 back into their original positions (see FIG. 3) in J-slots 210. The entire gravel packer 10 is then retrieved to the surface, leaving the packed gravel screen in the wellbore for subsequent production through a production packer and tubing.

Alternatively, mandrel assembly 14 and housing assembly 16 may be left in the wellbore as a permanent production packer assembly. This may be effected by applying left-hand torque to the tubing string and picking up, which disengages J-slots 82 from lugs 132. Crossover assembly 12 is then withdrawn from mandrel assembly 14 closing circulation ports 222 through the interaction of snap ring 126 with valve sleeve 240 in the process. Snap ring 126 then disengages sleeve 240 at the top of the latter's travel in sleeve bore 224. A tubing seal assembly at the end of production tubing may then be stabbed into seal bore 138 and the packed formation produced through mandrel assembly 14 and housing assembly 16.

Thus has been described a novel and unobvious apparatus for gravel packing a well. Of course, numerous additions, deletions and modifications to the preferred embodiment of the apparatus may be made without departing from the spirit and scope of the invention, as defined by the following claims.

I claim:

1. A gravel packer for placing a gravel pack in a wellbore about a gravel screen disposed therebelow across a producing formation comprising:

a gravel packer assembly;

a packer element disposed on the exterior of said assembly;

ratchet means in said assembly for releasably locking said packer element in a set mode;

an intake passage in said assembly for receiving fluid from a tubing string in said well bore and secured to said gravel packer;

a return passage in said assembly for receiving fluid from the interior of said gravel screen;

a circulation passage in said assembly extending from the exterior of said gravel packer below said packer element to said intake passage;

closeable crossover means associated with said assembly to receive fluid from said return passage and guide said received fluid from said return passage to the exterior of said assembly above said packer element;

first check valve means in said assembly for preventing flow to said gravel screen through said return passage;

second check valve means in said assembly adapted to selectively permit flow from said return passage to said intake passage in response to a positive pressure differential between said return passage and said intake passage; and J-slot means for selectively disconnecting said crossover means from said packer assembly.

2. The apparatus of claim 1, wherein said return passage, said first check valve means and said second check valve means are secured to said crossover means and adapted to be removed therewith from said packer assembly.

3. The apparatus of claim 2, wherein said first check valve means comprises a ball and seat disposed in said return passage, and said second check valve means comprises packer cup means disposed adjacent to a reversing passage extending from said return passage to said intake passage.

4. The apparatus of claim 3, further comprising a valve sleeve slidably disposed in said assembly adjacent said circulation passage and releasably secured to said crossover means.

5. The apparatus of claim 4, wherein said valve sleeve is disposed in said intake passage below said circulation passage, and is adapted to move upward in said passage in response to said removal of said crossover means and close said circulation passage, thereafter releasing from said crossover means.

6. A gravel packer, adapted to be suspended from a tubing string, for placing a gravel pack in a wellbore about a gravel screen disposed therebelow across a producing formation, comprising:

a crossover assembly including a ported crossover housing secured to said tubing string and having a crossover sleeve assembly slidably disposed therein, said sleeve assembly containing a tee-shaped passage extending from apertures in the exterior of said sleeve assembly to a tubular return mandrel disposed therebelow and secured to said sleeve assembly, first J-slot means at the lower end of said sleeve assembly, first check valve means disposed in said return mandrel, a reversing passage through the wall of said return mandrel, and second check valve means disposed about said return mandrel;

a mandrel assembly including overshot means at the upper end thereof having second J-shot means engageable with said first J-slot means associated therewith, tubular mandrel means below said overshot, first ratchet means associated with said mandrel means and circulation ports through said mandrel means; and a housing assembly including a compressible packer element, packer element compression means responsive to relative longitudinal movement between said mandrel and housing assemblies, and second ratchet means engageable with said first ratchet means.

7. The apparatus of claim 6, wherein said first check valve means comprises a check ball disposed above a ball seat in said return mandrel.

8. The apparatus of claim 7, wherein said second check valve means comprises an upward-facing packer cup disposed about said return mandrel above said reversing passage.

9. The apparatus of claim 8, further including a valve sleeve slidably disposed in said mandrel means below said circulation passage.

10. The apparatus of claim 9, wherein said packer cup seals against said valve sleeve in response to a positive pressure differential between the annular passage defined between said return mandrel and said mandrel means and the bore of said return mandrel.

11. The apparatus of claim 10, further including a snap ring disposed about said return mandrel and extending into a recess on the interior of said valve sleeve.

12. The apparatus of claim 11, wherein said crossover assembly is removable from said mandrel assembly upon disengagement of said first J-slot means from said second J-slot means.

13. The apparatus of claim 6, further including a valve sleeve slidably disposed in said mandrel means below said circulation passage.

14. The apparatus of claim 13, wherein said second check valve means seals against said valve sleeve in response to a positive pressure differential between the annular passage defined between said return mandrel and said mandrel means and the bore of said return mandrel.

15. The apparatus of claim 14, further including a snap ring disposed about said return mandrel and extending into a recess on the interior of said valve sleeve.

16. The apparatus of claim 15, wherein said crossover assembly is removable from said mandrel assembly upon disengagement of said first J-slot means from said second J-slot means.

17. The appartus of claim 16, and further including drag block means associated with said housing assembly.

18. The apparatus of claim 16, and further including third J-slot means on said mandrel assembly and fourth J-slot means associated with said housing assembly engageable with said third J-slot means for preventing compression of said packer element.

19. The apparatus of claim 16, and further including a bypass passage between said mandrel assembly and said housing assembly around said packer element, and bypass closure means operative in response to relative longitudinal movement of said mandrel and housing assemblies.

* * * * *